US011408618B2

(12) United States Patent
Iwase et al.

(10) Patent No.: US 11,408,618 B2
(45) Date of Patent: Aug. 9, 2022

(54) INDOOR UNIT OF AIR-CONDITIONER

(71) Applicant: Hitachi-Johnson Controls Air Conditioning, Inc., Tokyo (JP)

(72) Inventors: Taku Iwase, Tokyo (JP); Tomohiko Sato, Tokyo (JP); Yoko Sato, Tokyo (JP); Kunihito Kawamura, Tokyo (JP); Koutarou Nomura, Tokyo (JP); Naoyuki Fushimi, Tokyo (JP); Shinji Nakahata, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 190 days.

(21) Appl. No.: 16/424,754

(22) Filed: May 29, 2019

(65) Prior Publication Data

US 2020/0063983 A1 Feb. 27, 2020

Related U.S. Application Data

(63) Continuation of application No. PCT/JP2018/030766, filed on Aug. 21, 2018.

(51) Int. Cl.
*F24F 1/0047* (2019.01)
*F24F 13/30* (2006.01)
(Continued)

(52) U.S. Cl.
CPC ..... *F24F 1/0047* (2019.02); *F04D 29/703* (2013.01); *F24F 13/20* (2013.01); *F24F 13/30* (2013.01)

(58) Field of Classification Search
CPC ..... F24F 1/0047; F24F 13/20; F24F 13/30; F04D 29/703
See application file for complete search history.

(56) References Cited

U.S. PATENT DOCUMENTS 5,577,958 A 11/1996 Kumekawa et al.
9,897,335 B2 * 2/2018 Nouchi ..... F24F 1/0011
(Continued)

FOREIGN PATENT DOCUMENTS

CN 1125313 A 6/1996
EP 0926451 A1 6/1999
(Continued)

OTHER PUBLICATIONS

International Search Report of PCT/JP2018/030766 dated Nov. 20, 2018.
(Continued)

*Primary Examiner* — Gordon A Jones
(74) *Attorney, Agent, or Firm* — Mattingly & Malur, PC

(57) ABSTRACT

Provided is an indoor unit of an air-conditioner including: an indoor unit body configured to be provided in a ceiling; a suction port attached to a lower surface of the indoor unit body; a panel including a blow port for blowing conditioned air into a room; and a louver provided at the blow port of the panel to change an air sending direction. The panel includes an outer frame provided outside the blow port and provided with a substantially horizontal flat portion, and a protruding portion provided on the flat portion of the outer frame and protruding vertically downward. A lower end of the protruding portion is positioned vertically above a lower end of the louver. A lower end of an inner flow path wall surface forming a flow path wall surface inside the blow port is positioned vertically below the lower end of the louver.

11 Claims, 4 Drawing Sheets

(51) Int. Cl.
*F24F 13/20* (2006.01)
*F04D 29/70* (2006.01)

(56) References Cited

U.S. PATENT DOCUMENTS

| | | | | |
|---|---|---|---|---|
| 2002/0177400 | A1* | 11/2002 | Asahina | F24F 1/0047 454/233 |
| 2008/0034775 | A1* | 2/2008 | Choi | F24F 1/0011 62/259.1 |
| 2015/0253032 | A1* | 9/2015 | Kono | F24F 13/08 165/177 |
| 2019/0041085 | A1* | 2/2019 | Kono | F24F 13/1406 |
| 2020/0224889 | A1* | 7/2020 | Mochizuki | F24F 13/14 |

FOREIGN PATENT DOCUMENTS

| | | | |
|---|---|---|---|
| JP | 08-254325 | A | 10/1996 |
| JP | 10-160238 | A | 6/1998 |
| JP | 11-118233 | A | 4/1999 |
| JP | 11-248189 | A | 9/1999 |
| JP | 11-325573 | A | 11/1999 |
| JP | 2001-65911 | A | 3/2001 |
| JP | 2001-133030 | A | 5/2001 |
| JP | 2001-194000 | A | 7/2001 |
| JP | 2003-227648 | A | 8/2003 |

OTHER PUBLICATIONS

Chinese Office Action received in corresponding Chinese Application No. 201880003825.5 dated Aug. 20, 2020.

* cited by examiner

INDOOR UNIT OF AIR-CONDITIONER

CROSS-REFERENCE TO RELATED APPLICATION

The present application is a continuation application of International Application No. PCT/JP2018/030766, filed on Aug. 21, 2018, the contents of which is incorporated herein by reference in its entirety.

BACKGROUND

1. Technical Field

The present disclosure relates to an air-conditioner indoor unit including a decorative panel, and specifically relates to a ceiling-embedded indoor unit.

2. Related Art

For example, in cooling operation in a ceiling-embedded air-conditioner indoor unit, when low-temperature blown air (cold air) directly contacts an outer frame of a decorative panel, dew condensation tends to occur at the periphery of the outer frame of the decorative panel. When low-temperature blown air contacts a ceiling surface in a room at high speed, the ceiling surface is brought into such a wet state that slight dew condensation has occurred. When fine floating dust etc. in the blown air adheres to such a portion, a ceiling surface dirty state called smudging easily occurs.

A typical technique for solving this problem is, for example, described in JP-A-8-254325. In an indoor unit of an air-conditioner as described in JP-A-8-254325, a step configured to separate, from a lower surface of a decorative panel, the direction of wind blown along an inner wall of a blow port provided at the decorative panel is provided, and cold air is blown to spread diagonally downward. With this configuration, occurrence of smudging at a ceiling surface is reduced, and dew condensation at an outer frame of the decorative panel is prevented.

Another typical technique is described in JP-A-2003-227648. In JP-A-2003-227648, a wall surface of a blow port of a decorative panel includes a curved portion with a certain curvature toward below the blow port, a perpendicular portion having a flat portion continued from the curved portion and formed perpendicularly to a ceiling surface from an end portion of the flat portion, and a flat portion formed continuously from the perpendicular portion to an outer edge portion of the decorative panel. A heat insulating member is provided at the perpendicular portion. With the heat insulating member at the perpendicular portion, the necessity of an anti-condensation heater is eliminated, and dew condensation and dew formation at the periphery of the blow port of the decorative panel are prevented.

SUMMARY

An indoor unit of an air-conditioner according to an embodiment of the present disclosure includes an indoor unit body configured to be provided in a ceiling; a suction port fitted to a lower surface of the indoor unit body; a panel including a blow port for blowing conditioned air into a room; and a louver provided at the blow port of the panel to change an air sending direction, wherein the panel includes an outer frame provided outside the blow port and provided with a substantially horizontal flat portion, and a protruding portion provided on the flat portion of the outer frame and protruding vertically downward, a lower end of the protruding portion is positioned vertically above a lower end of the louver, and a lower end of an inner flow path wall surface forming a flow path wall surface inside the blow port is positioned vertically below the lower end of the louver.

DETAILED DESCRIPTION

Figure 1:
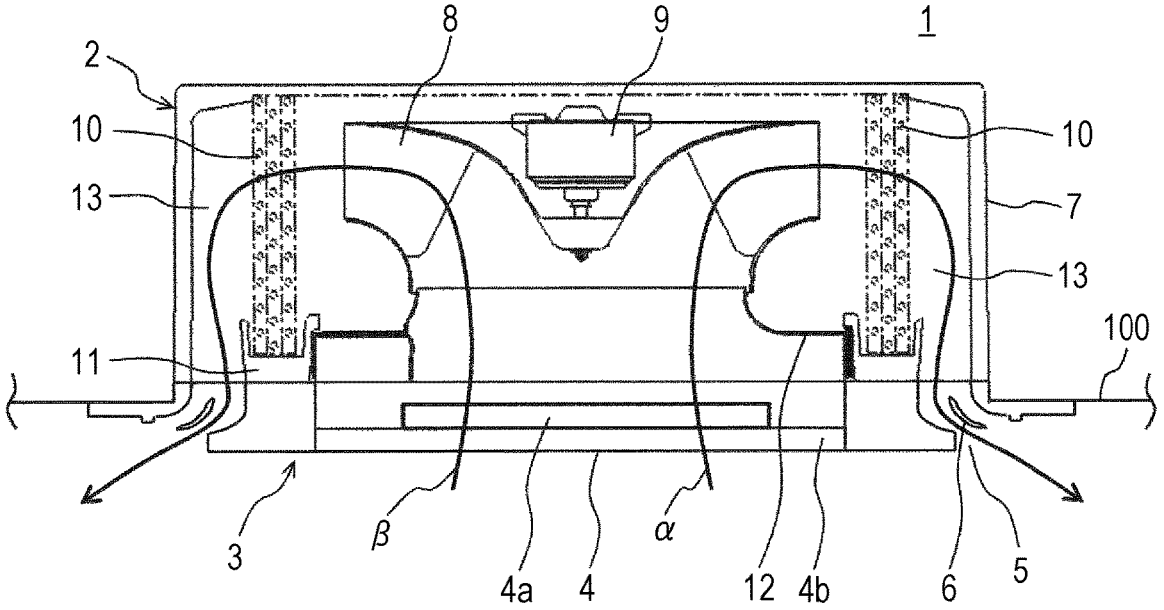
FIG. 1 is a longitudinal sectional view of Example 1 of an indoor unit of an air-conditioner according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Considering comfortability, a flow field parallel with a ceiling needs to be formed to avoid direct contact of cold air with a person in the cooling operation of the air-conditioner. Meanwhile, it is important for the decorative panel of the indoor unit of the air-conditioner to improve designability to match interiors in a room. Thus, the design of the decorative panel needs to be as simple as possible. Specifically, the outer frame of the decorative panel is configured with a horizontal surface parallel with the ceiling surface, and therefore, the simple design is realized.

Figure 8:
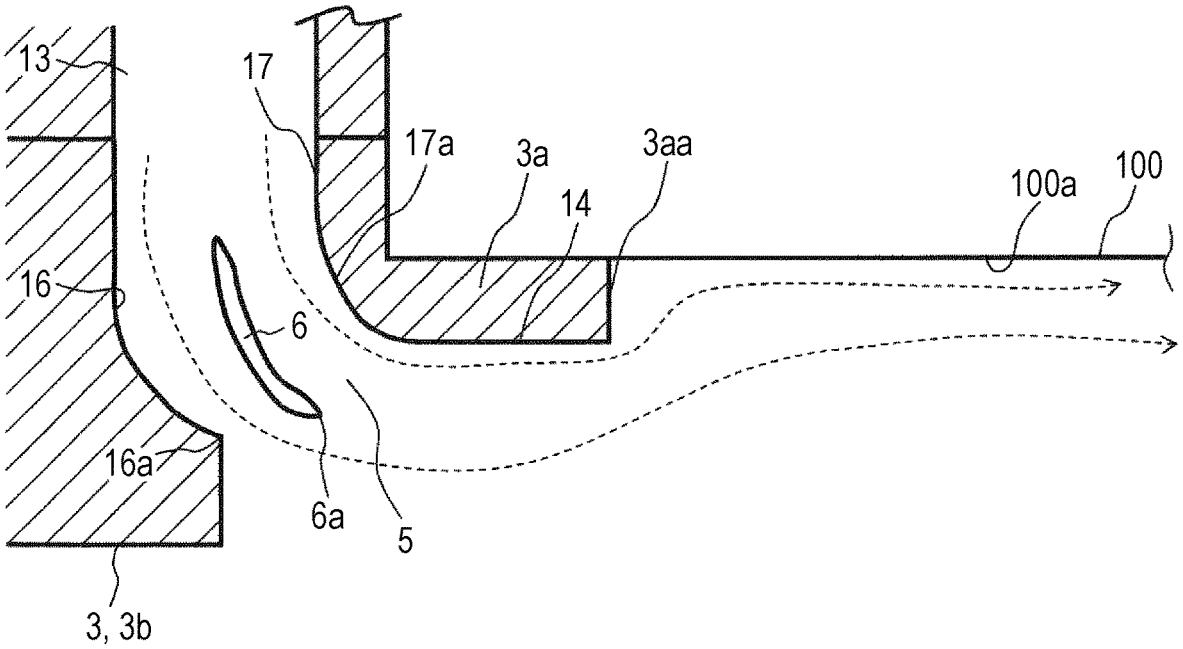
FIG. 8 is a sectional view of the vicinity of a blow port of an indoor unit of an air-conditioner with improved designability of a decorative panel.

FIG. 8 is a sectional view of the vicinity of a blow port 5 of an indoor unit of an air-conditioner with improved designability of a decorative panel. FIG. 8 illustrates a configuration in which an outer frame 3*a* of the decorative panel 3 has a flat portion 14 for improving the designability. In a case where the decorative panel 3 having such a structure that the flat portion 14 with favorable designability is provided at the outer frame 3*a* is placed as described above, when the angle of a louver 6 is adjusted to horizontally blow low-temperature air (cold air) through the blow port 5 as indicated by dashed arrows, the cold air directly contacts the flat portion 14 of the outer frame 3*a* of the decorative panel 3 and a ceiling surface 100*a* of a ceiling 100 close to the outer frame 3*a* of the decorative panel 3. As a result, there are problems that dew condensation occurs at the decorative panel 3 and smudging (contamination) occurs at the ceiling surface 100*a* close to the decorative panel 3.

Note that in FIG. 8, a reference numeral 3*b* indicates an inner frame of the decorative panel 3, and a reference numeral 13 indicates a blow flow path. The blow port 5 in the blow flow path 13 is formed by an inner flow path wall surface 16 and an outer flow path wall surface 17 provided at the decorative panel 3. A reference numeral 16*a* indicates a lower end of the inner flow path wall surface 16, a reference numeral 17*a* indicates a curved portion of the outer flow path wall surface 17, a reference numeral 6*a* indicates a lower end of the louver 6, and a reference numeral 3*aa* indicates an end portion of the outer frame 3*a*.

Using the techniques described in JP-A-8-254325 and JP-A-2003-227648, dew condensation and smudging as described above can be reduced. However, Patent Documents 1 and 2 fail to consider formation of the flow field parallel with the ceiling, and have problems in light of both of improvement of the designability of the decorative panel outer frame having the horizontal surface and ensuring of the comfortability by formation of the flow field parallel with the ceiling.

An object of the present disclosure is to provide an air-conditioner indoor unit configured so that designability of a decorative panel can be improved while a flow field parallel with a ceiling is formed and comfortability is ensured and occurrence of dew condensation and smudging can be reduced.

For accomplishing the above-described object, the present embodiment relates to an indoor unit of an air-conditioner, the indoor unit including an indoor unit configured to be body provided in a ceiling, a suction port fitted to a lower surface of the indoor unit body, a decorative panel having a blow port for blowing conditioned air into a room, and a louver provided at the blow port of the decorative panel to change an air sending direction. The decorative panel includes an outer frame provided outside the blow port and provided with a substantially horizontal flat portion, and a protruding portion provided on the flat portion of the outer frame and protruding vertically downward. A lower end of the protruding portion is positioned vertically above a lower end of the louver, and a lower end of an inner flow path wall surface forming a flow path wall surface inside the blow port is positioned vertically below the lower end of the louver.

According to the present embodiment, there is an advantageous effect that the air-conditioner indoor unit can be provided, the indoor unit being configured so that the designability of the decorative panel can be improved while the flow field parallel with the ceiling is formed and the comfortability is ensured and occurrence of dew condensation and smudging can be reduced.

Hereinafter, specific Examples of an indoor unit of an air-conditioner according to the present embodiment will be described with reference to the drawings. In each figure, elements with the same reference numerals indicate identical or equivalent elements.

EXAMPLE 1

Figure 2:
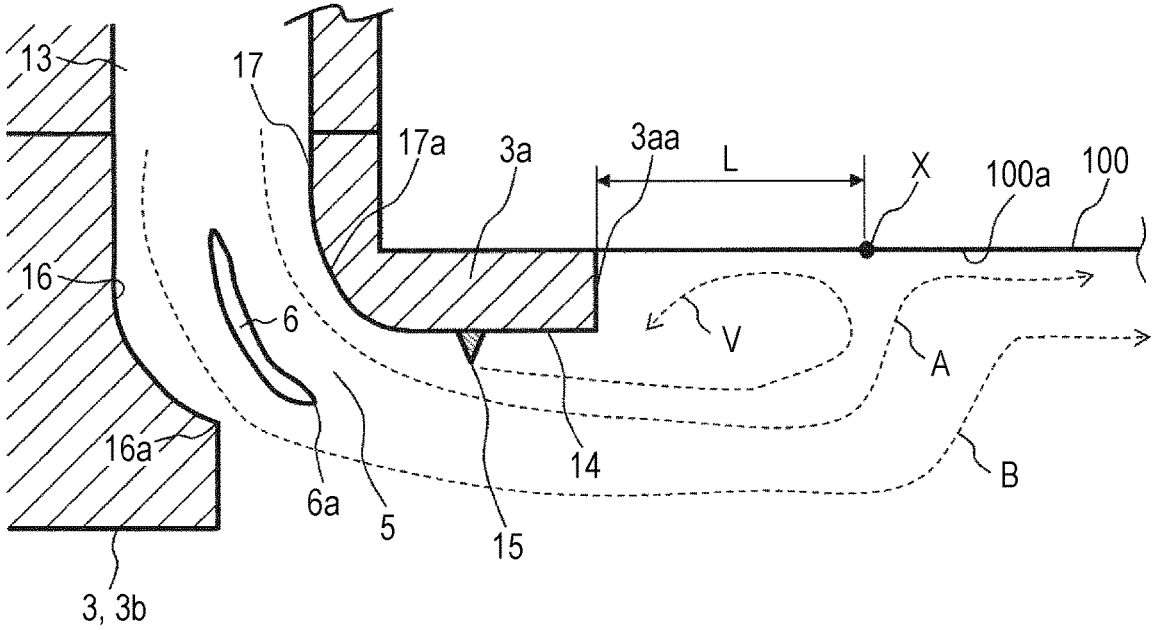
FIG. 2 is a sectional view of a main portion in the vicinity of a blow port illustrated in FIG. 1.

Example 1 of the indoor unit of the air-conditioner according to the present embodiment will be described with reference to FIGS. 1 and 2. FIG. 1 is a longitudinal sectional view of Example 1 of the indoor unit of the air-conditioner according to the present embodiment, and FIG. 2 is a sectional view of a main portion in the vicinity of a blow port illustrated in FIG. 1.

In FIG. 1, the indoor unit 1 of the air-conditioner includes an indoor unit body 2 provided inside a space of a ceiling 100, and a decorative panel 3 (one example of a panel) attached to a lower surface of the indoor unit body 2. Unless otherwise described, a vertical direction (the direction of gravitational force) is indicated as "lower," and the opposite direction of the vertical direction is indicated as "upper." The decorative panel 3 includes a suction port 4 at the center and the blow port 5 for blowing conditioned air into a room. Moreover, a louver 6 configured to change an air sending direction is provided at the blow port 5 of the decorative panel 3. The suction port 4 includes a suction filter 4*a* and a suction grille 4*b*.

The indoor unit body 2 includes a housing 7; a fan 8 provided at the center in the housing 7, such as a turbofan (a centrifugal fan); a motor 9 configured to rotate the fan 8; a substantially quadrilateral heat exchanger 10 provided to surround the outside of the fan 8; a drain pan 11 provided to cover a lower portion of the heat exchanger 10 to collect drain generated at the heat exchanger 10; and a bellmouth 12 configured to separate a suction side and a discharge side of the fan 8 from each other and to guide air sucked through the suction port 4 to the fan 8.

The pressure of indoor air sucked through the suction grille 4*b* and the suction filter 4*a* of the suction port 4 by the fan 8 is increased by the fan 8, and then, the resultant air is blown by the fan 8. Such air exchanges heat with refrigerant flowing in a refrigerant pipe of the heat exchanger 10 by way of the heat exchanger 10, thereby turning into cooled or heated conditioned air. After having passed through a blow flow path 13 formed between an outer surface of the heat exchanger 10 and an inner surface of the housing 7, the conditioned air is blown into the room through the blow port 5 of the decorative panel 3. The louver 6 provided at the blow port 5 is configured to adjust an air blow direction to a downward direction or a horizontal direction. Note that arrows α, β illustrated in FIG. 1 indicate the flow of air blown into the room through the blow port 5 after the air has been sucked through the suction port 4 and has passed through the fan 8 and the heat exchanger 10.

Next, a configuration of the vicinity of the blow port 5 illustrated in FIG. 1 will be described with reference to FIG. 2 as the sectional view of the main portion in the vicinity of the blow port 5. As illustrated in FIG. 2, the decorative panel 3 includes an outer frame 3*a* provided outside the blow port 5 and having a substantially horizontal flat portion 14, and the outer frame 3*a* includes a protruding portion 15 provided on the flat portion 14 and having a triangular section protruding vertically downward. Moreover, it is configured such that a lower end of the protruding portion 15 is positioned vertically above a lower end 6*a* (a louver back edge portion) of the louver 6.

The blow port 5 of the blow flow path 13 provided at the decorative panel 3 is formed by an inner flow path wall surface 16 and an outer flow path wall surface 17. Moreover, it is configured such that a lower end 16*a* of the inner flow path wall surface 16 is positioned vertically below the lower end 6*a* of the louver 6.

The outer flow path wall surface 17 is formed at the outer frame 3*a* of the decorative panel 3, and on a lower side of the outer flow path wall surface 17, a curved portion 17*a* smoothly connected to the flat portion 14 is formed.

The outer frame 3*a* of the decorative panel 3 is attached in close contact with a ceiling surface 100*a* of the ceiling 100. In the present example, the outer frame 3*a* of the decorative panel 3 has the horizontal flat portion 14 parallel with the ceiling surface 100*a*. Thus, the decorative panel 3 has a simple configuration, and designability thereof is improved.

Moreover, it is configured such that the lower end 16*a* of the inner flow path wall surface 16 is positioned vertically below the lower end 6*a* of the louver 6. Further, a lower end side of the inner flow path wall surface 16 is formed in such a curved shape that the flow of blown air is guided to the horizontal direction toward the lower end 16*a* as a terminal end. With this configuration, the flow of blown air can be efficiently guided to the horizontal direction, and the louver 6 has such a structure that the louver 6 does not protrude downward from the suction grille 4*b* and an inner frame 3*b* of the decorative panel 3. From this point of view, the designability is also improved.

Next, features and advantageous effects of the indoor unit of the air-conditioner of Example 1 will be described with reference to FIG. 2. In FIG. 2, a flow A indicated by a dashed arrow is made along the outer flow path wall surface 17, and separates due to contact with the protruding portion 15 after having been blown through the blow port 5. Thus, blown air (cold air in cooling operation) does not directly contact the outer frame 3*a* of the decorative panel 3. Meanwhile, upon separation of the flow A, an eddy V is generated outside an end portion 3*aa* of the outer frame 3*a*. Due to action of the eddy V, the flow A contacts a location (a re-contact point X) of the ceiling surface 100*a* apart from the end portion 3*aa* of the outer frame 3*a* by a distance L, and thereafter, forms a flow field parallel with the ceiling surface 100*a*.

On the other hand, a flow B indicated by a dashed arrow is a flow along the inner flow path wall surface 16. However, since the lower end 16*a* of the inner flow path wall surface 16 is positioned vertically below the lower end (the back edge portion) 6*a* of the louver 6, the action of horizontally blowing air is accelerated for the flow B. The flow B is made along the flow A, and therefore, can form a flow field parallel with the ceiling surface 100*a*.

With the flow fields as described above, the flow fields parallel with the ceiling surface 100*a* can be formed without degradation of the designability, and therefore, direct contact of cold air with a person can be reduced in the cooling operation and comfortability can be ensured.

Further, no cold air directly contacts the outer frame 3*a* of the decorative panel 3, and therefore, dew condensation at the periphery of the outer frame 3*a* of the decorative panel 3 can be prevented. Moreover, at the re-contact point X at the location apart from the outer frame 3*a* of the decorative panel 3 by the distance L, the flow A contacts the ceiling surface 100*a*. However, a flow velocity at the periphery of the re-contact point X is reduced, and therefore, occurrence of smudging at the ceiling surface 100*a* can also be reduced.

As described above, according to Example 1, there is an advantageous effect that for the indoor unit of the air-conditioner, the designability of the decorative panel can be improved while the flow fields parallel with the ceiling are formed and the comfortability is ensured and occurrence of dew condensation and smudging can be reduced.

EXAMPLE 2

Figure 3:
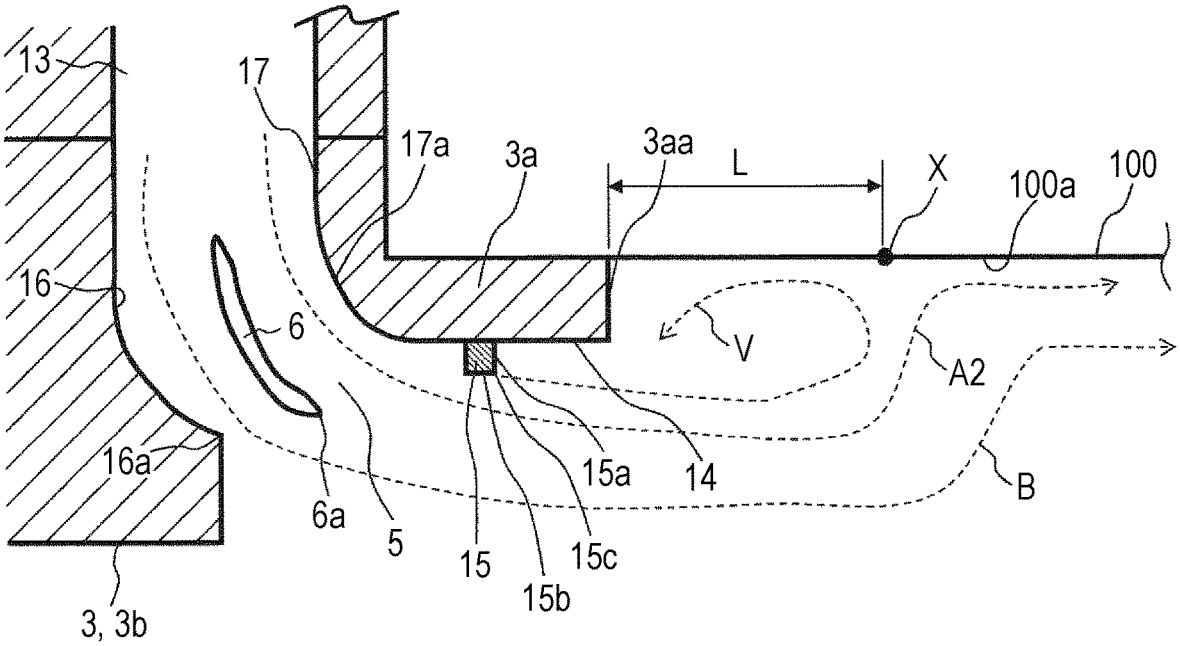
FIG. 3 is a sectional view of a main portion of Example 2 of the indoor unit of the air-conditioner according to an embodiment of the present disclosure, the view corresponding to FIG. 2.

Example 2 of the indoor unit of the air-conditioner according to the present embodiment will be described with reference to FIG. 3. FIG. 3 is a sectional view of the vicinity of a blow port of the indoor unit of the air-conditioner of Example 2. Note that in FIG. 3, elements with reference numerals similar to those of FIGS. 1 and 2 indicate identical or equivalent elements. In description of Example 2, description of contents similar to those of Example 1 will be omitted, and different contents will be mainly described.

In Example 2, the shape of a protruding portion 15 is, as illustrated in FIG. 3, different from that of Example 1. That is, in Example 1, the section of the protruding portion 15 is formed in the triangular shape, but Example 2 is different in that the section of the protruding portion 15 is formed in a quadrangular (rectangular) shape.

With this configuration of the present example, the protruding portion 15 is in a shape having an outer wall surface 15*a* perpendicular to a flat portion 14 of an outer frame 3*a* and a lower surface 15*b* parallel with the flat portion. Further, the outer wall surface 15*a* and the lower surface 15*b* form an edge 15*c*. As a result, in Example 2, a flow A2 (a flow made along an outer flow path wall surface 17 and contacting the protruding portion 15 after having been blown through the blow port 5) indicated by a dashed arrow can be reliably separated at a portion corresponding to the edge 15*c*.

As described above, according to Example 2, separation at the protruding portion 15 can be more reliably generated as compared to Example 1 illustrated in FIG. 2. Thus, in addition to advantageous effects similar to those of Example 1, the effect of preventing dew condensation at the periphery of the outer frame 3*a* of a decorative panel 3 and the effect of reducing occurrence of smudging at a ceiling surface 100*a* can be further improved.

EXAMPLE 3

Figure 4:
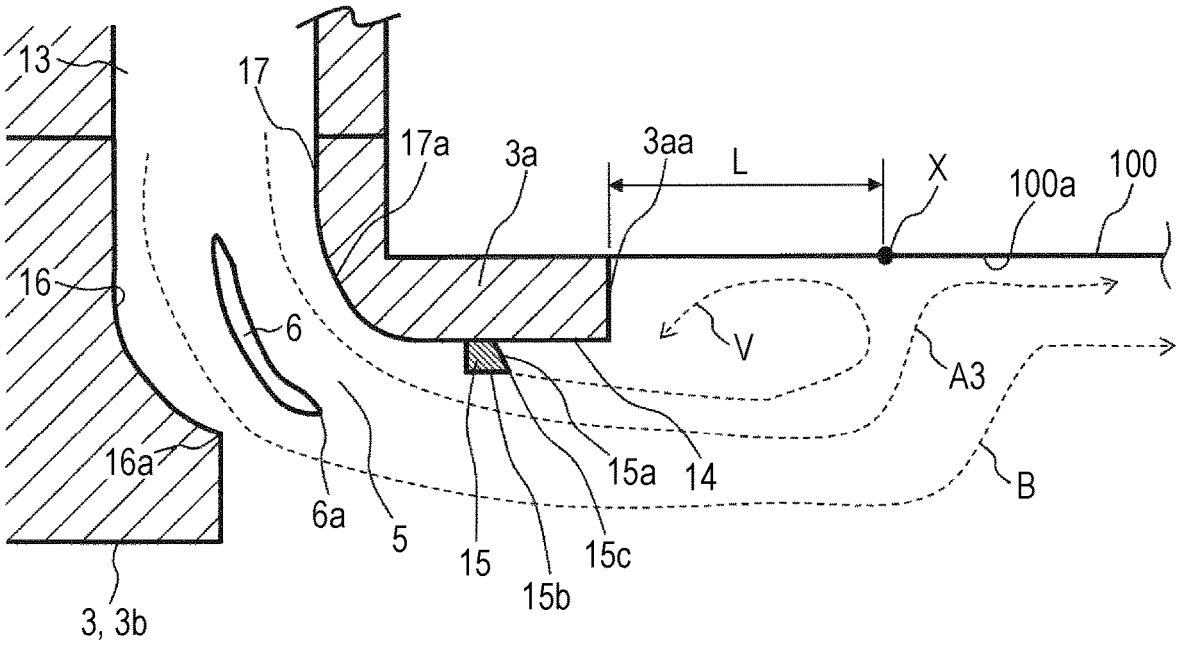
FIG. 4 is a sectional view of a main portion of Example 3 of the indoor unit of the air-conditioner according to an embodiment of the present disclosure, the view corresponding to FIG. 2.

Example 3 of the indoor unit of the air-conditioner according to the present embodiment will be described with reference to FIG. 4. FIG. 4 is a sectional view of the vicinity of a blow port of the indoor unit of the air-conditioner of Example 3. Note that in FIG. 4, elements with reference numerals similar to those of FIGS. 1 to 3 indicate identical or equivalent elements. In description of Example 3, description of contents similar to those of Examples 1 and 2 will be omitted, and different contents will be mainly described.

In Example 3, the shape of a protruding portion 15 is, as illustrated in FIG. 4, different from those of Examples 1 and 2. That is, Example 1 has described the example where the section of the protruding portion 15 is in the triangular shape, and Example 2 has described the example where the section of the protruding portion 15 is in the quadrangular shape. However, in Example 3, the section of the protruding portion 15 is formed in a trapezoidal shape, and the trapezoidal protruding portion 15 has an outer wall surface 15*a* whose angle with respect to a flat portion 14 of an outer frame 3*a* is an acute angle, a lower surface 15*b* parallel with the flat portion 14, and an acute-angled edge 15*c* formed by the outer wall surface 15*a* and the lower surface 15*b*. Other configurations are similar to those of Example 2.

With the configuration of Example 3, the angle of the edge 15*c* formed by the outer wall surface 15*a* and the lower surface 15*b* is the acute angle, and therefore, the edge 15*c* stands out more. Thus, separation of a flow A3 (a flow made along an outer flow path wall surface 17 and contacting the protruding portion 15 after having been blown through the blow port 5) indicated by a dashed arrow illustrated in FIG. 4 can be much more reliably made as compared to that of Example 2 illustrated in FIG. 3. Thus, the advantageous effects of Example 1 or 2 can be more reliably obtained.

As described above, according to Example 3, separation at the protruding portion 15 can be more reliably generated as compared to Examples 1 and 2. Thus, in addition to advantageous effects similar to those of Examples 1 and 2, the effect of preventing dew condensation at the periphery of the outer frame 3*a* of a decorative panel 3 and the effect of reducing occurrence of smudging at a ceiling surface 100*a* can be further improved.

EXAMPLE 4

Figure 5:
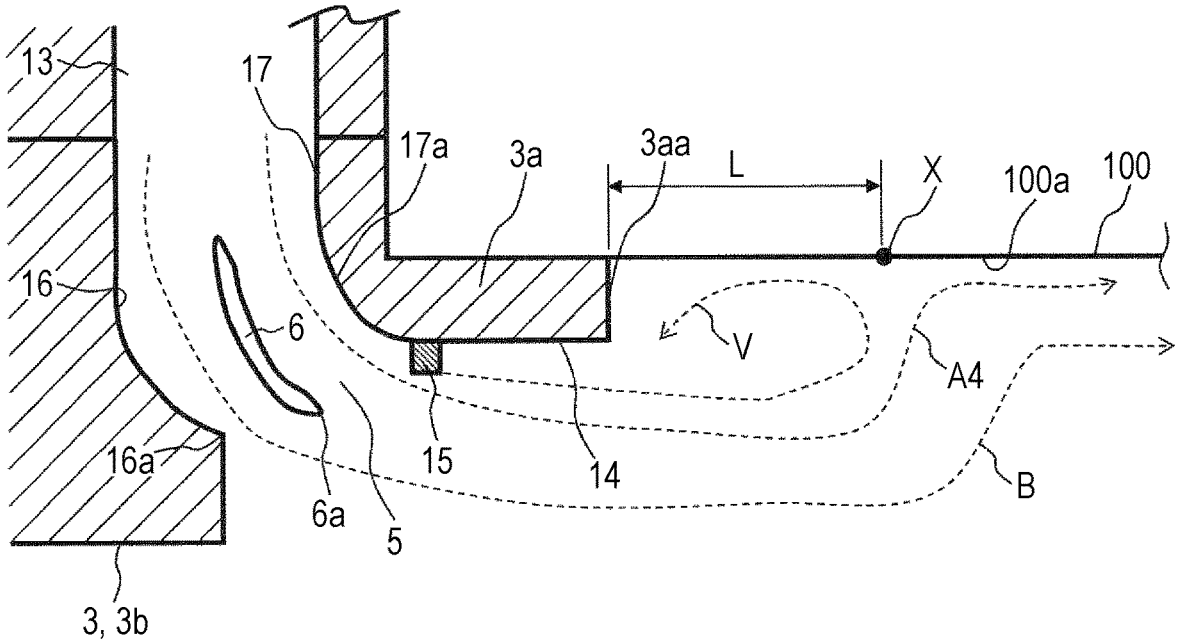
FIG. 5 is a sectional view of a main portion of Example 4 of the indoor unit of the air-conditioner according to an embodiment of the present disclosure, the view corresponding to FIG. 2.

Example 4 of the indoor unit of the air-conditioner according to the present embodiment will be described with reference to FIG. 5. FIG. 5 is a sectional view of the vicinity of a blow port of the indoor unit of the air-conditioner of Example 4. Note that in FIG. 5, elements with reference numerals similar to those of FIGS. 1 to 3 indicate identical or equivalent elements. In description of Example 4, description of contents similar to those of Examples 1 and 2 will be omitted, and different contents will be mainly described.

In Example 4, the sectional shape of a protruding portion 15 is, as illustrated in FIG. 5, formed in a quadrangular (rectangular) shape as in Example 2. A difference of the present example from Example 2 is that a placement location of the protruding portion 15 is a location at which a curved portion 17*a* of an outer flow path wall surface 17 formed at an outer frame 3*a* of a decorative panel 3 at the blow port 5 changes to a horizontal flat portion 14. With the configuration of Example 4, the protruding portion 15 is placed at such a location that a flow structure changes. Thus, separation of a flow A4 (a flow contacting the protruding portion 15 after having been blown through the blow port 5) can be reliably made, and the advantageous effects described in Example 2 can be more reliably obtained.

Note that the sectional shape of the protruding portion 15 is not limited to the quadrangular shape, and may be the triangular shape illustrated in FIG. 2 or the trapezoidal shape illustrated in FIG. 4. In this case, the advantageous effects described in Example 1 or Example 3 can be more reliably obtained.

EXAMPLE 5

Figure 6:
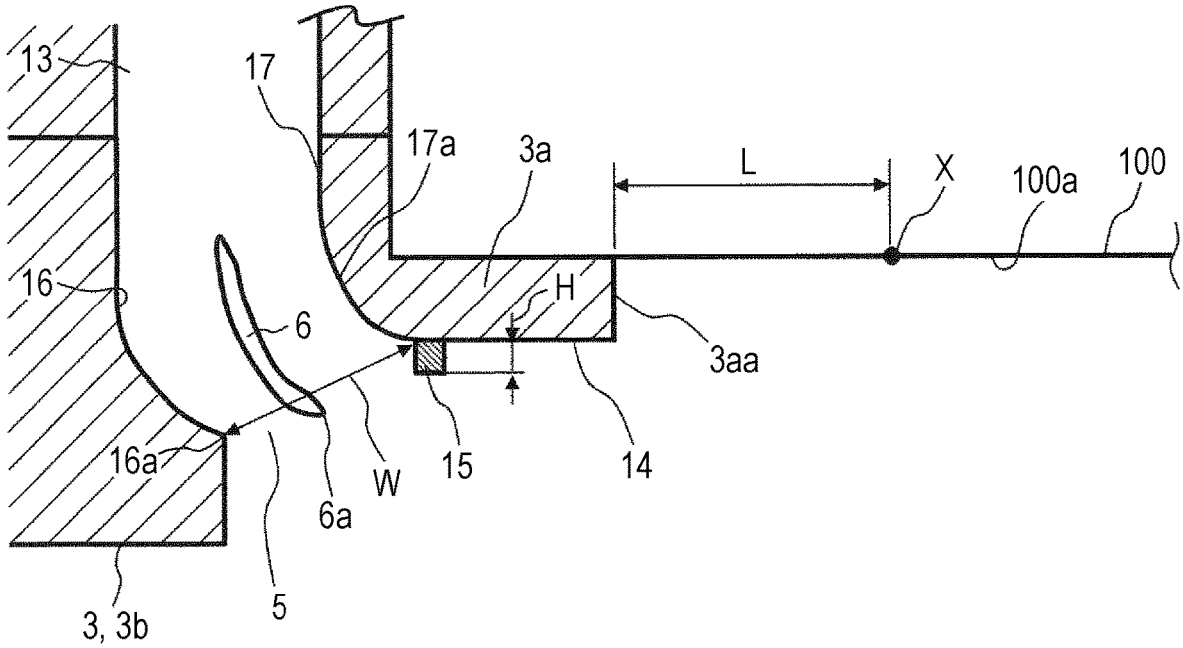
FIG. 6 is a view for describing the height H of a protruding portion in the vertical direction, the width W of a blow port, and a distance L from an outer frame end portion of a decorative panel to a blown air flow re-contact point X of a ceiling surface in Example 4 illustrated in FIG. 5.

Example 5 of the indoor unit of the air-conditioner according to the present embodiment will be described with reference to FIGS. 6 and 7. FIG. 6 is a view for describing the height H of the protruding portion in the vertical direction, the width W of the blow port, and a distance L from an outer frame end portion of the decorative panel to the blown air flow re-contact point X of the ceiling surface in Example 4 illustrated in FIG. 5, and FIG. 7 is a diagrammatic view for describing a relationship between the ratio H/W of the protruding portion height to the blow port width and the ratio L/W of the distance from the outer frame end portion of the decorative panel to the blown air flow re-contact point of the ceiling surface to the blow port width.

FIG. 6 is the view for describing each dimension of the height H of the protruding portion in the vertical direction, the width W of the blow port, and the distance L from the outer frame end portion of the decorative panel to the blown air flow re-contact point X of the ceiling surface, and a basic shape as an indoor unit is similar to that described with reference to FIG. 5. The width W of the blow port 5 is defined as a distance between an intersection between a curved portion 17*a* of an outer flow path wall surface 17 and a flat portion 14 of an outer frame (an intersection between the curved portion 17*a* and the protruding portion 15) and a lower end 16*a* of an inner flow path wall surface 16. As described above, the distance L is a length from an end portion 3*aa* of the outer frame 3*a* to the re-contact point X.

Figure 7:
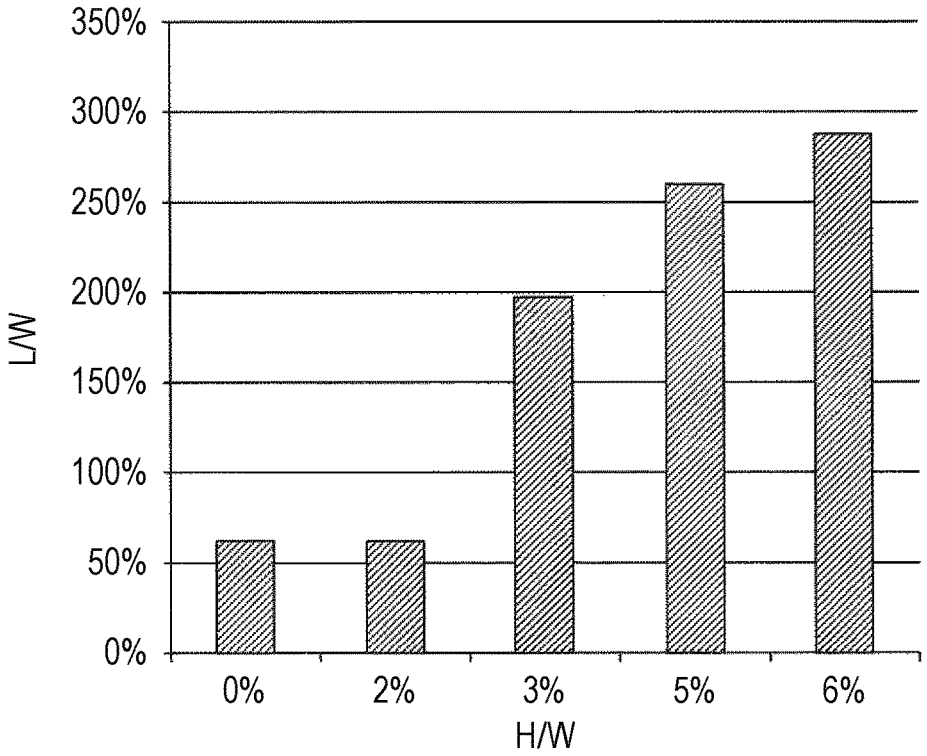
FIG. 7 is a diagrammatic view for describing a relationship between the ratio H/W of the height of the protruding portion to the width of the blow port and the ratio L/W of the distance from the outer frame end portion of the decorative panel to the blown air flow re-contact point X of the ceiling surface to the width of the blow port.

FIG. 7 is a diagrammatic view of results obtained by numerical fluid computation for the relationship between the ratio H/W of the height H of the protruding portion 15 in the vertical direction to the width W of the blow port 5 and the ratio L/W of the distance L from the end portion 3*aa* of the outer frame 3*a* of the decorative panel 3 to the re-contact point X to the width W of the blow port 5.

Computation was targeted for a general ceiling-embedded indoor unit configured such that four blow ports 5 as illustrated in FIG. 1 are provided, and was performed in such a manner that parameter survey is performed for the height H of the protruding portion 15 illustrated in FIG. 6 under such conditions that the outer diameter of a fan 8 is 450 mm and the number of rotations of the fan 8 is 860 rpm. The sectional shape of the protruding portion 15 was in a quadrangular shape as illustrated in FIG. 6, and each of the height H of the protruding portion 15 and the distance L from the end portion 3*aa* of the outer frame 3*a* to the re-contact point X was dimensionlessly calculated with W.

As a result, it has been found that the ratio H/W of the height H of the protruding portion 15 to the width W of the blow port 5 is, as illustrated in FIG. 7, set to equal to or higher than 3%, and in this manner, the ratio L/W of the distance L from the end portion 3*aa* of the outer frame 3*a* of the decorative panel 3 to the re-contact point X to the width W of the blow port 5 can be significantly increased. That is, it has been found that a significant increase in the distance L can be expected by a ratio H/W of equal to or higher than 3%. As the distance L increases, a flow velocity in the vicinity of the re-contact point X can be decreased, and smudging caused at the ceiling surface 100*a* can be significantly reduced.

The ratio H/W is desirably equal to or higher than 3% as described above, but it has also been found that when the ratio H/W reaches equal to or higher than 6%, the increment rate of the ratio L/W is rapidly decreased. Moreover, when the height of the protruding portion 15 is too high, designability is degraded, and the flow direction of conditioned air blown through the blow port 5 is a downward direction. Thus, cold air tends to directly contact a person, and comfortability is degraded. For this reason, the ratio H/W is preferably 3% to 6%.

Note that in description of Example 5, the protruding portion 15 is, as in Example 4, provided at such a location that the curved portion 17*a* of the outer flow path wall surface 17 changes to the horizontal flat portion 14. However, even in a case where the protruding portion 15 is provided on the flat portion of the outer frame as in Examples 1 to 3, a significant increase in the distance L is, as in FIG. 7, expected by a ratio H/W of equal to or higher than 3% and preferably a ratio H/W of 3% to 6%.

As described above, according to the indoor unit of the air-conditioner of each example of the present disclosure, the decorative panel includes the outer frame provided outside the blow port and provided with the substantially horizontal flat portion, and the protruding portion provided on the flat portion of the outer frame and protruding vertically downward. Further, it is configured such that the lower end of the protruding portion is positioned vertically above the lower end of the louver and the lower end of the inner flow path wall surface forming the flow path wall surface inside the blow port is positioned vertically below the lower end of the louver. With this configuration, the designability of the decorative panel with the flat portion can be improved while the flow fields parallel with the ceiling are formed and the comfortability is ensured, and occurrence of dew condensation and smudging can be reduced.

Note that the present embodiment is not limited to the above-described Examples, and include various modifications. Moreover, the above-described Examples have been specifically described for the sake of clear description of the present embodiment, and are not limited to one including all configurations described above.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An indoor unit of an air-conditioner, comprising:

an indoor unit body configured to be provided in a ceiling;

a suction port fitted to a lower surface of the indoor unit body;

a panel including a blow port for blowing conditioned air into a room; and a louver provided at the blow port of the panel to change an air sending direction, wherein the panel includes:

an outer frame provided outside the blow port and including an upper surface that engages with the ceiling, a lower surface opposite the upper surface and parallel to the upper surface that includes a horizontal flat portion in a horizontal plane, and an end portion which is in a vertical plane that is orthogonal to the horizontal flat portion and orthogonal to the upper surface, the end portion in the vertical plane engages with the ceiling, a protruding portion disposed on the horizontal flat portion and protruding vertically downward from the horizontal flat portion, wherein a lower end of the protruding portion is positioned vertically above a lower end of the louver, wherein a lower end of an inner flow path wall surface forming a flow path wall surface inside the blow port is positioned vertically below the lower end of the louver, and wherein at least a portion of the horizontal flat portion exists between the protruding portion and the blow port.

2. The indoor unit of the air-conditioner according to claim 1, wherein the blow port provided at the panel has the inner flow path wall surface and an outer flow path wall surface, and a curved portion connected to the flat portion of the outer frame is provided at the outer flow path wall surface.

3. The indoor unit of the air-conditioner according to claim 2, wherein a lower end side of the inner flow path wall surface forming the blow port is formed in such a curved shape that a blown air flow is guided to a horizontal direction.

4. The indoor unit of the air-conditioner according to claim 1, wherein a section of the protruding portion is formed in a triangular shape.

5. The indoor unit of the air-conditioner according to claim 1, wherein a section of the protruding portion is formed in a quadrangular shape, and the quadrangular protruding portion has an outer wall surface perpendicular to the flat portion of the outer frame, a lower surface parallel with the flat portion, and an edge formed by the outer wall surface and the lower surface.

6. The indoor unit of the air-conditioner according to claim 1, wherein a section of the protruding portion is formed in a trapezoidal shape, and the trapezoidal protruding portion has an outer wall surface whose angle with respect to the flat portion of the outer frame is an acute angle, a lower surface parallel with the flat portion, and an acute-angled edge formed by the outer wall surface and the lower surface.

7. The indoor unit of the air-conditioner according to claim 2, wherein the protruding portion is provided at such a location that the curved portion at the outer flow path wall surface forming the blow port changes to the flat portion.

8. The indoor unit of the air-conditioner according to claim 2, wherein when a distance between an intersection between the curved portion of the outer flow path wall surface and the flat portion of the outer frame and the lower end of the inner flow path wall surface is defined as a width W of the blow port and a height of the protruding portion is H, a ratio H/W of the height H of the protruding portion to the width W of the blow port is equal to or higher than 3%.

9. The indoor unit of the air-conditioner according to claim 8, wherein the ratio H/W falls within a range of 3% to 6%.

10. The indoor unit of the air-conditioner according to claim 1, wherein the panel further includes an inner frame which includes the lower end of the inner flow path wall surface, wherein the inner frame includes a lowest surface which is parallel to the horizontal flat portion, and a first surface orthogonal to the lowest surface, wherein the lower end of the inner flow path wall surface intersects with the first surface and the intersection is vertically below the lower end of the louver.

11. The indoor unit of the air-conditioner according to claim 1, wherein a thickness of the outer frame in a vertical direction is the same in a first vertical plane that includes the protruding portion and the vertical plane that includes the end portion.

* * * * *